United States Patent [19]

Conrad

[11] 4,134,590

[45] Jan. 16, 1979

[54] CUSTOMIZABLE GOLF PARLOR GAME

[76] Inventor: Robert J. Conrad, 9214 River Oaks Rd., Harrison, Tenn. 37341

[21] Appl. No.: 756,737

[22] Filed: Jan. 4, 1977

[51] Int. Cl.[2] ..... A63F 3/00

[52] U.S. Cl. ..... 273/245; 273/240

[58] Field of Search ..... 273/134 CG, 134 ES, 273/134 CB, 134 DB, 134 AG, 87.2, 87.4, 87, 245, 240

[56] References Cited

U.S. PATENT DOCUMENTS

| | | | |
|---|---|---|---|
| 1,334,176 | 3/1920 | Seagrave | 273/134 CG |
| 1,535,126 | 4/1925 | McNair et al. | 273/134 CG |
| 1,541,202 | 6/1925 | Winbigler | 273/134 CG |
| 1,605,739 | 11/1926 | Jennings | 273/134 CG |
| 1,615,982 | 2/1927 | Jewett | 273/134 CG |
| 1,736,523 | 11/1929 | Decker | 273/134 CG |
| 2,157,172 | 5/1939 | Hays | 273/134 CG |
| 2,478,949 | 8/1949 | Snyder | 273/134 CG |
| 3,260,526 | 7/1966 | Seitz | 273/134 CG |
| 3,355,175 | 11/1967 | Carrol et al. | 273/134 CG |
| 3,410,561 | 11/1968 | Ekstrand | 273/134 CG |
| 3,612,534 | 10/1971 | Browne | 273/134 CG |
| 3,697,072 | 10/1972 | Park | 273/134 CG |
| 3,910,581 | 10/1975 | Nicholson | 273/134 CG |
| 3,912,270 | 10/1975 | Trossman et al. | 273/134 CG |
| 3,944,229 | 3/1976 | Feeney | 273/134 CG |

FOREIGN PATENT DOCUMENTS

| | | | |
|---|---|---|---|
| 914886 | 7/1946 | France | 273/134 CG |
| 1164056 | 10/1969 | United Kingdom | 273/134 CG |

*Primary Examiner*—Richard C. Pinkham
*Assistant Examiner*—Harry G. Strappello
*Attorney, Agent, or Firm*—Cushman, Darby & Cushman

[57] ABSTRACT

A golf parlor game for participation by one or more players includes a random number generator, a plurality of club play cards associated with each player, hole layouts having indicia in the form of golf course holes, ball markers for plotting a shot of given distance and character, determined from a play card, on the hole layouts and distance markings for facilitating the plotting of a shot of given distance on a hole layout. The club play cards have first indicia thereon for indicating an actual golf club associated therewith (i.e. a one-wood or all of number four, five and six irons), and second indicia thereon corresponding to all the possible numbers generated by the random number generator and indicating the distance and character of a shot, different shot distance and character being associated with different numbers on each card. A player plays a number of hole layouts until a predetermined round is completed, each hole layout being played by selecting various club play cards and activating the random number generator upon selection of each play card until a player's ball marker on that hole layout is disposed in the hole. A plurality of customizable club play cards having the first indicia thereon, but not the second indicia thereon, may also be provided.

9 Claims, 20 Drawing Figures

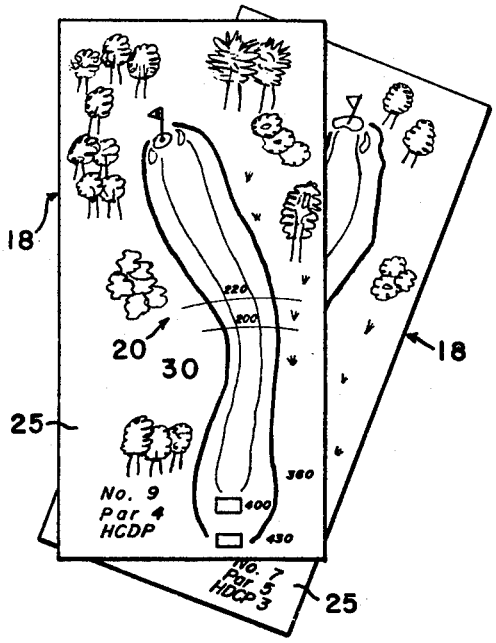
Fig. 3
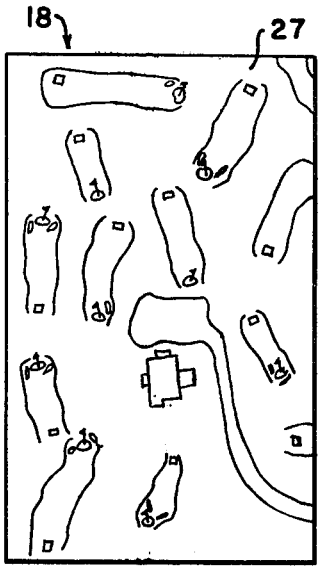
Fig. 4
Fig. 7a
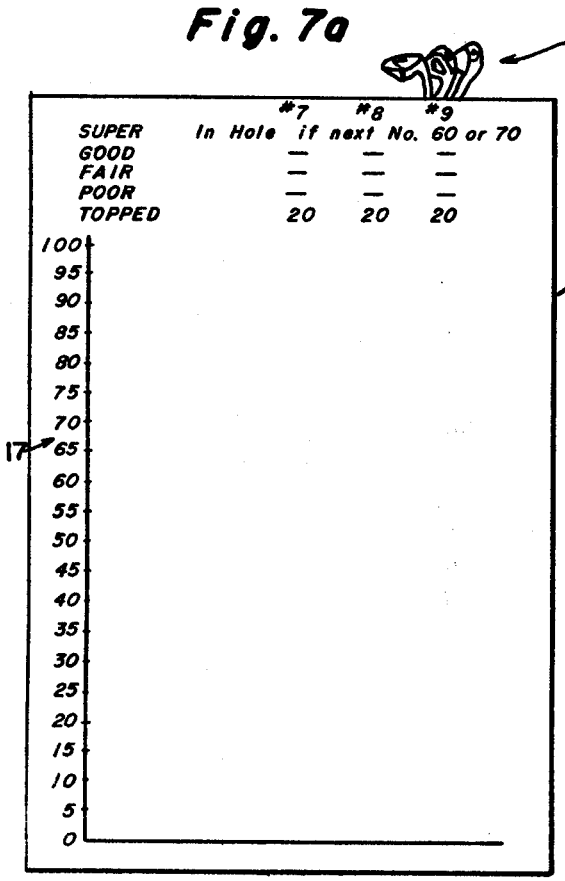
Fig. 7b
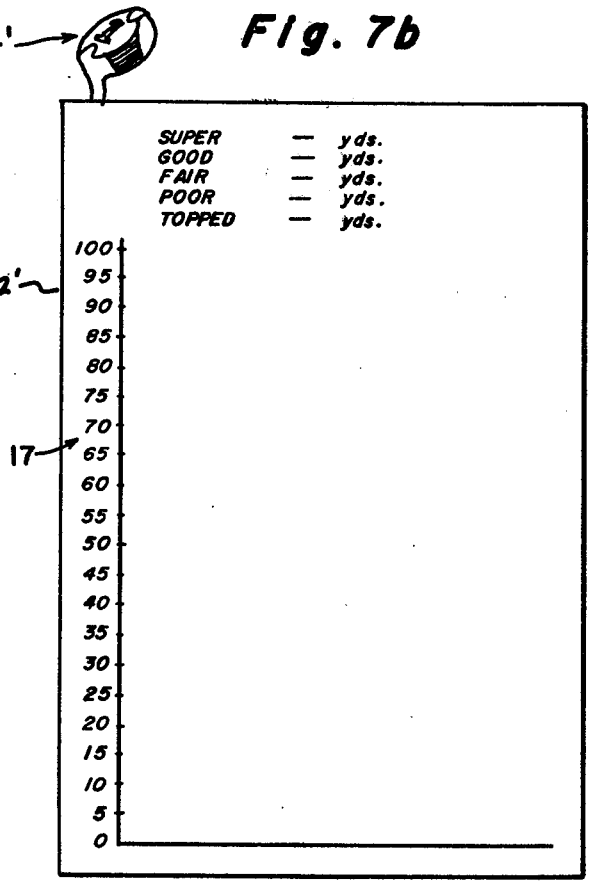

CUSTOMIZABLE GOLF PARLOR GAME

BACKGROUND & SUMMARY OF THE INVENTION

The invention relates to a golf parlor game for participation by one or more players. There are many golf parlor games known in the prior art, such as shown by U.S. Pat. Nos. 1,535,126; 1,605,739; 3,260,526; and 3,612,534, all of such prior art golf games utilizing a wide variety of charts, graphs, cards and chance means for simulating the play of a round of golf by the participants. While all of these prior art games contain various aspects of a real golf game, oftentimes they contain so many charts, chance means, graphs, etc. that it is extremely difficult to predetermine the distance and character of each "shot" during the game and the realistic probabilities associated with shots taken during the game suffers unless all the complicated charts, graphs, etc. are used. Additionally, there is no manner in which the individual player can relate the probabilities of the "shot" selectors utilized to that particular player's actual golf game and, therefore, the game might not have a realistic character to the individual player.

According to the present invention, a golf parlor game is provided that provides only two simple devices for determining the character and distance of each "shot" during play — a random number generator and a plurality of club play cards associated with each player, yet the probabilities associated with each "shot" of given distance and character are very realistic. Additionally, according to the present invention, an apparatus and method are provided for customizing club play cards to suit an individual participant's own, real golf game so that the parlor game has a realistic nature and so that it might actually be used as an instruction means for the golfer to improve his club selection and his actual golf game.

According to the apparatus of the present invention, a golf parlor game for participation by one or more players is provided comprising a random number generator, a plurality of club play cards associated with each player, at least one hole layout having indicia in the form of a golf course hole, at least one ball marker positioned on a hole layout, and distance marking means for facilitating the plotting of a shot of a given distance on a hole layout. The club play cards each have first indicia thereon for indicating an actual golf club associated therewith (i.e. one-wood, two and three irons, putter, etc.) and second indicia thereon corresponding to all the possible numbers generated by said random number generator and indicating the distance and character of a shot, different shot distance and character associated with different numbers on each card, preferably the random number generator comprises means for generating a two-digit number from 00 through and including 99, each of the numbers essentially being indicated on each club play card. Additionally, to provide customizing of the game to an actual golf course played by the participant, means for customizing the hole play cards to selectively provide various modifications of the character of said hole play cards are provided, said means comprising a plurality of cutouts of sheet material corresponding to the various golf shot obstacles and the like (i.e. lakes, sandtraps, tee placements, etc.). The distance marking means may comprise a ruler having indicia thereon corresponding to distance indicia on the club play cards for marking shots on the hole layout. Additionally, a plurality of customizable club play cards having said first indicia thereon, but not said second indicia, shot distance and character representation thereon, are provided; said cards being customizable to provide accurate probabilities of shot distance and character corresponding to a player's actual golfing ability. A shot analysis chart may also be provided for use by the individual player during actual golf rounds in order to assist in determining probabilities for customizing the customizable play cards.

A method of customizing club play cards to correspond to a player's actual golfing ability in a golf parlor game according to the present invention comprises the steps of classifying each real shot taken with each real golf club corresponding to a golf play card during one or more real rounds of golf into one of several categories indicated on a shot analysis chart and recording the shot on the shot chart. The percentage of real shots in each category for each club card on the shot analysis chart are calculated after completion of the sample number of golf rounds, and indicia corresponding to the calculated percentage of shots of each category are placed on each club play card opposite a corresponding percentage of numbers on the club play card. Preferably, the random number generator associated with the game comprises means for generating a two-digit number from 00 through and including 99, each of said numbers being indicated in each play card, and the step of placing indicia on the club play cards is accomplished by marking each calculated percentage off by grouping a plurality of said numbers corresponding in magnitude to the number of calculated percentage points.

It is a primary object of the present invention to provide a simplified yet realistic golf parlor game, and to provide a game and method that allows for customization of the game to correspond to an individual participant's actual golfing ability. This and other objects of the invention will become clear from an inspection of the detailed description of the invention and from the appended claims.

BRIEF DESCRIPTION OF THE DRAWINGS

FIG. 3 is a showing of an exemplary hole layout card;

FIG. 4 is a schematic of a whole course layout board that may optionally be utilized according to the invention;

FIGS. 7A–7B are exemplary customizable club play cards utilizable in practicing the method of the present invention;

DETAILED DESCRIPTION OF THE INVENTION

The Game Apparatus

Figure 1:
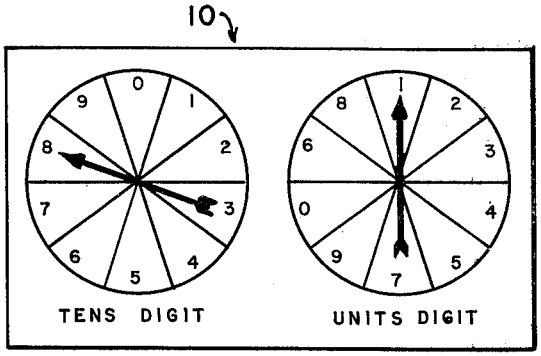
FIG. 1 is a schematic view of an exemplary random number generator utilizable according to the present invention.
Figure 6:
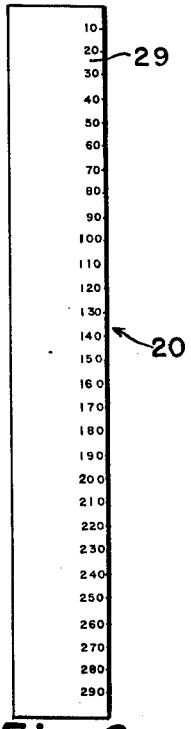
FIG. 6 is a schematic showing exemplary distance marking means.

A golf parlor game for participation by one or more players is shown in exemplary form in FIGS. 1–9 of the drawings. The golf parlor game comprises a two-digit random number generator 10 (as shown in FIG. 1), a plurality of club play cards 12 (as shown in FIGS. 2A–2C), each club play card having first indicia 14 formed thereon for indicating an actual golf club associated therewith and second indicia 16 thereon corresponding to all the possible numbers generated by said random number generator 10 and indicating the distance and character of a "shot", different shot distance and character associated with different numbers on each card, at least one card hole layout 18 (as shown in FIG. 3) having indicia in the form of a golf course hole thereon, at least one ball marker 19 positionable on a hole layout 18 after plotting a shot of given distance and character, determined from a club play card 2, on the hole layout 18, and distance marking means 20 as shown in FIG. 6 for facilitating the plotting of a shot of given distance on a hole layout 18.

Each of the component parts of the game, according to the present invention, may take variety of forms. It is preferred that the random number generator 10 (as shown in FIG. 1) comprise means for generating a two-digit number from 00 through and including 99, each of said numbers essentially being indicated on each club play card 12. As shown in FIG. 1, the random number generator 10 comprises two spinners each having numbers 0 through 9 associated therewith. Or the random number generator 10 may comprise two bags (not shown), one containing 10 balls or discs uniquely numbered 00, 10, 20, 30, . . . 90. The other containing 10 wood golf tees numbered differently, 0, 1, 2, . . . 9. One ball and one tee are drawn and the numbers added to generate a random number, 00 through and including 99.

Figure 2A:
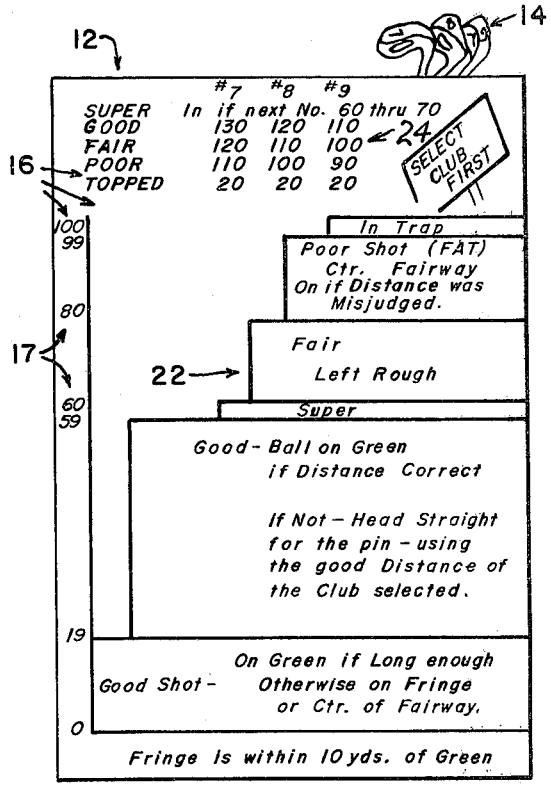
FIGS. 2A–2C are exemplary club play cards.
Figure 2C:
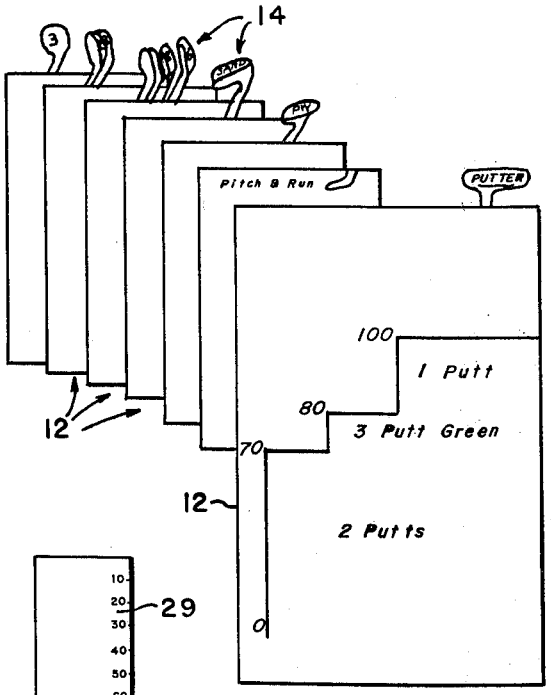
Figure 2B:
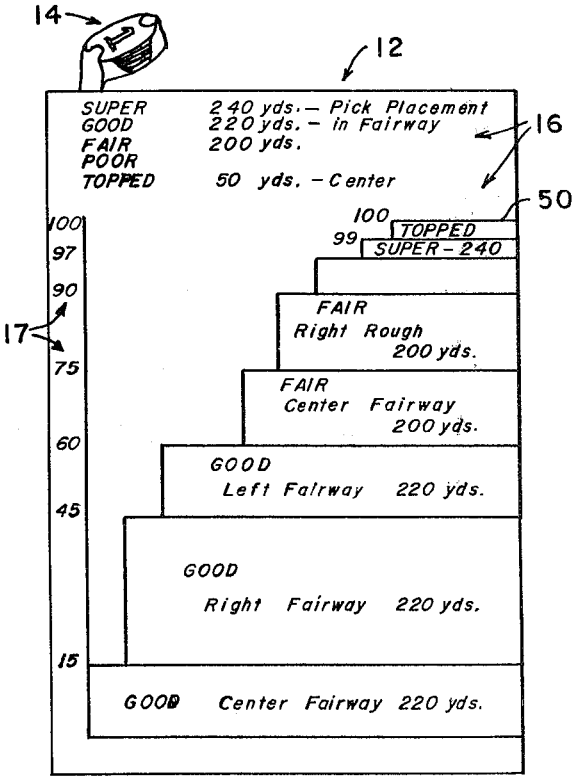

As shown in FIGS. 2A–2C, the first indicia 14 on each of the club play cards 12 preferably comprises an extension of the club card 12 in the form of a golf club head corresponding to the actual golf club represented by the club play card 12, with the number of the club thereon. Other first indicia could also be used, however. The second indicia 16 exemplified in FIGS. 2A–2C includes a graph listing the distance (topped, poor, fair, good, super) and character (center fairway, right rough, etc.) of the shot, the distance and character shot indicia corresponding to the particular percentages related to the numbers 17 corresponding to numbers on the random number generator 10. More than one club may be associated with each card (corresponding to actual clubs that are quite related in use and which a player is likely to hit with the same distance and character — although the exact distance depending upon the club selected might vary), as shown in FIG. 2A in particular. The card 12 shown in FIG. 2A has first indicia 14 indicating irons 7, 8 and 9 and the indicia 16 includes one indicia portion 22 giving the character and distance of each shot, but giving the distance of each shot in terms of "good", "fair", etc. rather than in yardage as is possible for club play cards having only one club indicia 14 associated therewith (see yardage notations on the card 12 shown in FIG. 2B), and the distances "good", "fair", etc. are then related to an indicia portion 24 of the card 12 that indicates objectively in yards what each subjective distance indicated in portion 22 is corresponding to a selected iron 7, 8, 9 of the card 12. Although a wide variety of cards could be utilized according to the present invention, it is preferred that a card 12 be provided corresponding to each of the following: one-wood; three-wood; two and three-irons; four, five and six-irons; sand wedge; full (or pitching) wedge; seven, eight and nine irons; pitch and run; and putter. The putter card may be seen clearly in FIG. 2C and it is preferred that the putter card — utilizable when a player reaches the green of a hole layout card 18 — has the shot distance and character indicia thereon provided by the number of putts necessary to hole the ball on the green (i.e., one, two or three putts, etc.).

Exemplary hole layouts according to the present invention are shown both in FIGS. 3 and 4. In FIG. 3, the hole layouts 18 are shown in the form of a plurality of individual hole cards 25, each card having indicia formed thereon in the form of a golf course, including a green, fairway, tee, etc. In place of or in addition to the cards 25, the hole layouts can be provided in the form of a board 27, such as shown in FIG. 4. If the cards 25 are to be utilized, the board 27 will merely provide perspective as to how each of the holes represented by cards 25 are situated relative to each other, with actual ball markings being provided on the cards 25.

Figure 5:
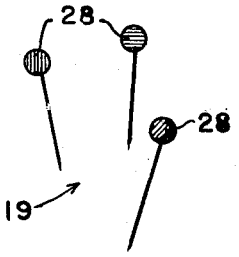
FIG. 5 is a perspective view of exemplary ball marking means.

The ball marking means 19, as shown in FIG. 5, may comprise a plurality of straight pins each having a head portion 28 thereof of a given color, each player in the game having a ball marker 19 with a different colored head 28; alternatively felt discs (not shown) could be used as ball markers. After a shot of given distance and chracter, determined from a club play card 12 related to a number generated by the random number generator 10, a ball marker 19 is positioned on a hole layout 18 at the given position. Distance marking means for facilitating the plotting of a shot of a given distance on a hole layout may comprise a variety of means 20, such as a ruler 29 in FIG. 6, or the distance markings 30 shown on the hole layout card 25 in FIG. 3, or like means.

In order to add variety to the game, or in order to relate it to actual golf course holes on which a player is to be playing for practice purposes, means are provided for customizing the hole play cards 25. Such means are shown schematically in FIG. 9 and comprise a plurality of cut-outs of sheet material corresponding to various gold shot obstacles and the like. For instance, a cut-out 31 corresponding to woods may be provided, as well as cut-outs 32 (lake), 33 (rough), 34 (tee placement), and 35 (green). The cut-outs may be fit to the hole course layout cards 25 by any suitable means, such as releasable adhesive.

Exemplary Rules of Play

Exemplary rules of play for utilizing the game apparatus according to the present invention are as follows:

Play starts at the tee of the number 1 hole play card 25, the player up selecting the club play card 12 he wishes to use and then generating a two-digit number on the random generator 10. The number generated is then compared to the numerical listing 17 on the club play card 12 selected to provide the outcome of the shot (shot distance and character). The player then spots his location on the hole play card 25 with a ball pin 19, with the aid of the yardage ruler 29 if necessary. The next player up then selects the club play card 12 of his choice, and generates a new random number with the generator 10, and follows a similar procedure. After all players have teed off, shots are made in rotation of furthest from the hole shooting first, just as in the playing of a real round of golf. The yardage marker 29 is used only after shots to measure the distance, the distance must be mentally judged prior to making the shot. Putting order on the green and honors are determined just as in real golf.

After driving off from the tee, the fairway woods (i.e., three-wood), two or three iron card, four, five or six iron card, or seven, eight or nine iron card may be used, it being necessary for the player to inspect the cards and determine what the best probability of making the green is. The sand wedge may only be used from sand traps, and it is necessary to use the sand wedge in the sand traps. The putter may be used only when the green is reached, and need not be used if the play has "holed-out" by a previous shot. Play continues through hole layout cards 25 (numbers 1–18) until a round is completed, and each of the individual players' scores is kept on a scorecard or the like.

Customizing the Game

Figure 8:
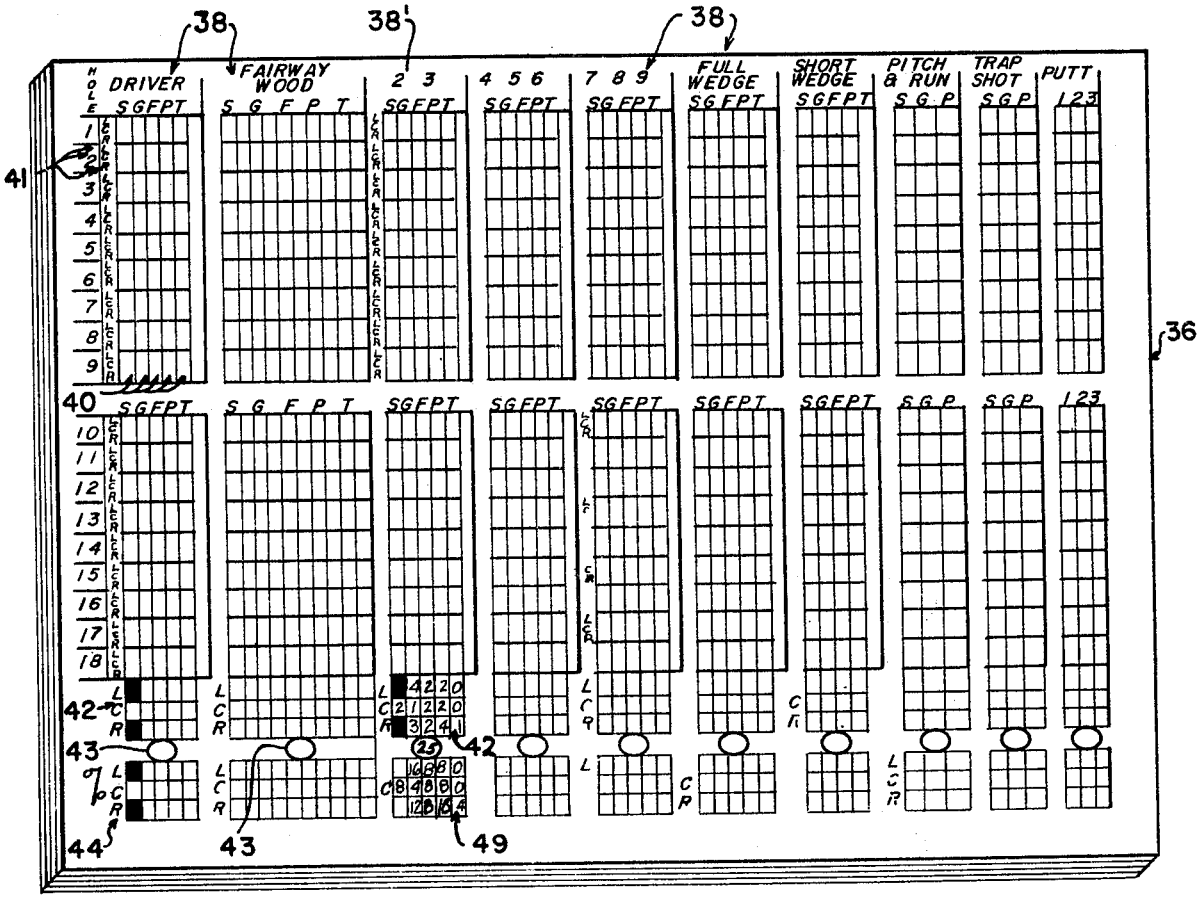
FIG. 8 is a showing of an exemplary shot analysis chart for practicing the method according to the present invention.
Figure 9:
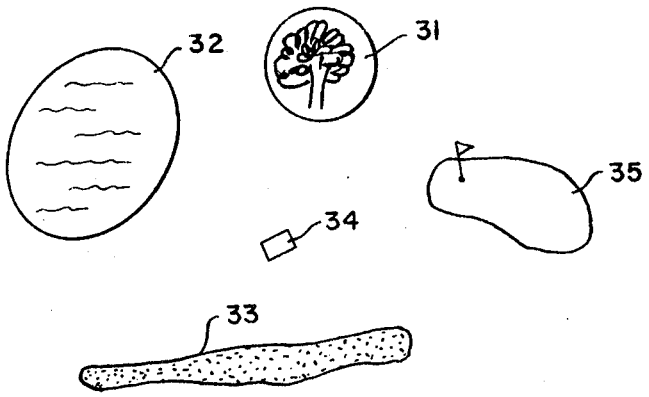
FIG. 9 is a schematic showing of exemplary hole customizing means utilizable with the hole layout cards according to the invention.

In order to make the game as realistic as possible for an individual player, and to make the game so that it may be used as a tool for an individual player in improving his club selection, a plurality of customizable club play cards 12′ preferably are provided (see FIGS. 7A and 7B for exemplary cards). Each of the customizable club play cards has first indicia 14′ thereon, but does not have the second indicia 16 thereon, although the numbers 17 corresponding to the random number generator 10 are plotted thereon. Since the second indicia 16 are not provided, no shot distance and character representations are provided for the cards, and these must be determined by actual play. A shot analysis chart 36 (which may be in the form of a pad as shown in FIG. 8) is provided to assist the player in customizing the cards 12′. The shot analysis chart includes indicia 38 thereon correspondong to the indicia 14′ of individual customizable club play cards 12′ and for each indicia 38 there is provided several shot categories 40 corresponding to shots of particular distance and character. For instance, super (S), good (G), fair (F), poor (P) and topped (T), categories 40 may be provided for each indicia 38 correspondong to a club play card 12′. The individual player will determine what catetory 40 each shot he makes falls into and will provide an estimated distance of that category on a generic basis. It is suggested that a drive not in the fairway be rated not better than F on the analysis chart — a drive may have been long enough to be rated G; however, rating it F sets up a longer next shot (this compensates somewhat for hitting from the rough). Each of the categories 40 is also subdivided into subcategories 41 which correspond to the left, center and right providing a further evaluation of the character of the shot. Using the indicia 38 and the categories 40, 41, a player classifies each real shot taken with each real golf club corresponding to a club play card 12′ during one or more real rounds of golf into one of the categories 40 (41) indicated on the shot analysis chart 36, and records the shot on the chart.

After completion of a sample number of rounds of golf, the percentage of real shots in each category for each club card on the shot analysis chart 36 is calculated. Although this may be done by a number of methods, it may most easily be done by utilizing the "totals" indicia 42 at the bottom of each indicia 38 on the shot analysis chart 36. The number of marks on each column and subcolumn is entered in the corresponding square on indicia 42, giving one the total number of shots of each character during sample rounds. Attention is directed to two indicia 38′ in FIG. 8 wherein sample numbers have been filled in at portion 42. The total of all the numbers at the portion 42 are then added up and this total is placed in a circle 43. Then the numbers in each square in section 42 are divided by the number in circle 43, and this resultant calculated percentage is placed in the corresponding square of section 42 at 44. This has also been done for indicia 38′ in FIG. 8.

After calculation of the percentages, indicia corresponding to the calculated percentage of each category is placed opposite a corresponding percentage of numbers 17 on the corresponding customizable club play card 12′. For instance, referring to indicia 38′ in FIG. 8, for the example given, 8% of the numbers 17 would be determined and then a line would be drawn across the card 12′ perpendicular to the line containing the numbers 17 and below that line would be written "super shot"; similarly, another line would be drawn after 16% of the numbers 17 and between that line and the "super" line would be written "good shot — on green if distance correct, otherwise fringe or center fairway"; and similarly for each of the calculated percentages. As can be seen, the indicia placement step according to the method of the present invention is greatly simplified if the random number generator 10 is capable of generating essentially 100 random numbers (two-digit numbers from 00 through and including 99) in which case the lines are drawn merely at numbers 17 corresponding to the given percentage points. Of course, it is up to each individual golfer to classify each of his "super", "good", etc., shots for each club or set of clubs depending upon his situation and the thought processes that are necessary for the player to go through in making such classifications and determinations can also be beneficial to improving a golfer's game. Of course, the customizable cards 12′ may be periodically revised should the golfer make significant improvements in his game.

It will thus be seen according to the present invention that a realistic golf parlor game, with simplified apparatus has been provided and a method and apparatus have been provided for customizing the golf game so that the play corresponds to a player's actual golfing ability. Thus, the primary object of the present invention has been achieved.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent apparatus and methods.

What is claimed:

1. A golf parlor game for participation by one or more players, comprising:

a random number generator;

a plurality of club play cards associated with each player, each club play card having first indicia thereof for indicating an actual golf club associated therewith, and second indicia thereon corresponding to all the possible numbers generated by said random number generator and indicating the distance and character of a shot, different shot distance and character associated with different numbers on each card;

a plurality of customizable club play cards having said first indicia thereon, but not said second indicia shot distance and character representations thereon, said cards being customizable to provide accurate probabilities of shot distance and character corresponding to a player's actual golfing ability;

at least one hole layout having indicia in the form of a golf course hole;

at least one ball marker positionable on a hole layout after plotting a shot of given distance and character, determined from a club play card, on the hole layout; and distance marking means for facilitating the plotting of a shot of given distance on a hole layout.

2. A game as recited in claim 1 wherein said at least one hole layout comprises a plurality of hole play cards, one card corresponding to each hole to be played, and a whole course layout having indicia thereon corresponding to each of said hole play cards for providing perspective for the location of holes corresponding to said hole play cards.

3. A game as recited in claim 1 further comprising a shot analysis chart having indicia thereon corresponding to each of said individual customizable club play cards to assist in determining probabilities for customizing said customizable club play cards.

4. A game as recited in claim 3 wherein said shot analysis chart comprises several groups of shot category columns formed thereon associated with hole indicia of a golf course, a group of shot category columns being associated with each customizable club play card.

5. A game as recited in claim 4 further comprising indicia on said shot analysis chart dividing each of said category columns formed thereon into subcategories which correspond to left, center, and right shots for further evaluation of shot character.

6. A game as recited in claim 1 wherein said first indicia on one club play card comprises indicia indicating irons 4, 5, and 6 and wherein different distances are indicated corresponding to each of said irons on said card, all of said irons having common character indicia, and wherein another club play card comprises indicia indicating irons 7, 8 and 9.

7. A game as recited in claim 6 further comprising other club play cards having a first indicia thereon respectively indicating irons 2 and 3, a 1 wood, a 3 wood, a putter, sand wedge, a full wedge, and pitch and run.

8. A game as recited in claim 1 wherein said distance marking means comprises a ruler having indicia thereon corresponding to distance indicia on said club play cards for marking shots on said hole layout.

9. A game as recited in claim 1 wherein said random number comprises means for generating a two-digit number from 00 through and including 99, each of said numbers essentially being indicated on each club play card and being indicatable on each of said customizable club play cards.

* * * * *